US012385703B2

(12) United States Patent
Baker et al.

(10) Patent No.: US 12,385,703 B2
(45) Date of Patent: Aug. 12, 2025

(54) MODIFICATIONS FOR AR-10 STYLE FIREARM

(71) Applicant: Great Lakes Firearms and Ammunition, LLC, Sparta, MI (US)

(72) Inventors: Matthew Baker, Rockford, MI (US); Chase Blackburn, Cedar Springs, MI (US)

(73) Assignee: Great Lakes Firearms and Ammunition, LLC, Sparta, MI (US)

( * ) Notice: Subject to any disclaimer, the term of this patent is extended or adjusted under 35 U.S.C. 154(b) by 0 days.

(21) Appl. No.: 18/198,721

(22) Filed: May 17, 2023

(65) Prior Publication Data

US 2024/0384954 A1 Nov. 21, 2024

(51) Int. Cl.
*F41A 3/66* (2006.01)
*F41A 19/30* (2006.01)
*F41A 21/00* (2006.01)

(52) U.S. Cl.
CPC ..... *F41A 3/66* (2013.01); *F41A 19/30* (2013.01); *F41A 21/00* (2013.01)

(58) Field of Classification Search
CPC ..... F41A 11/02
See application file for complete search history.

(56) References Cited

U.S. PATENT DOCUMENTS

| | | | | |
|---|---|---|---|---|
| 10,054,379 | B2 * | 8/2018 | Lammers | F41C 23/04 |
| 11,015,884 | B2 * | 5/2021 | Drake | F41A 3/66 |
| 2018/0335266 | A1 * | 11/2018 | Cochran | F41A 17/38 |
| 2020/0064090 | A1 * | 2/2020 | Russell | F41A 9/70 |

FOREIGN PATENT DOCUMENTS

| | | | | |
|---|---|---|---|---|
| WO | WO-2015035122 | A1 * | 3/2015 | F41A 15/14 |
| WO | WO-2016091246 | A1 * | 6/2016 | F41A 3/66 |

OTHER PUBLICATIONS

WO-2016091246-A1 (Year: 2016).*

* cited by examiner

*Primary Examiner* — Reginald S Tillman, Jr.
(74) *Attorney, Agent, or Firm* — GrowIP Law Group LLC

(57) ABSTRACT

The present disclosure provides example embodiments related to modifications for an AR-10 style firearm. In one embodiment, the AR-10 style firearm comprises modifications that enable the AR-10 style firearm to fire cartridges having a length between 73.66 mm and 91.44 mm, without increasing the overall length and/or weight, as compared to a standard AR-10 style firearm. The modified AR-10 style firearm may comprise, for example, modifications to the upper receiver, lower receiver, bolt carrier, magazine well, charging handle, firing pin, buffer tube weight, and/or the magazine.

18 Claims, 10 Drawing Sheets

159

MODIFICATIONS FOR AR-10 STYLE FIREARM

BACKGROUND

AR-10 style firearms are widely used today by big game hunters and for law enforcement and tactical/defensive military uses. AR-10 style firearms are popular because of their power and accuracy at long range. Many big game hunters prefer using larger caliber ammunition, instead of the standard .308 Winchester ammunition. Traditionally, retrofitting of an AR-10 style firearm to accept larger ammunition requires elongated components that result in a firearm of increased size and weight, thereby resulting in an AR-10 style firearm that is more difficult to handle and fire.

SUMMARY

The present disclosure includes various embodiments that generally relate to an AR-10 style firearm comprising modifications that enable the AR-10 style firearm to fire a cartridge that is between 73.66 mm (2.9 inches) and 91.44 mm (3.6 inches) long without increasing the overall length and/or weight of the modified AR-10 style firearm, as compared to the standard AR-10 style firearm.

In one aspect, an AR-10 style firearm may comprise an upper receiver, and a lower receiver coupled to the upper receiver, wherein the lower receiver has a magazine well, along with a barrel coupled to the upper receiver, wherein the barrel is configured to fire a cartridge with a length between 73.66 mm and 91.44 mm, and a magazine configured to be received in the magazine well, the magazine having the cavity configured to receive a cartridge with a length between 73.66 mm and 91.44 mm.

In another aspect, the AR-10 style firearm may further comprise a buttstock coupled to a barrel, and wherein the firearm is a rotating bolt firearm that has a length of a standard AR-10 that extends from the first end of the barrel to the second end of the buttstock.

In another aspect, the AR-10 style firearm may further comprise modifications to locations and lengths of components located on, for example, the upper receiver, the lower receiver, the bolt carrier, the charging handle, and the firing pin.

In another aspect, the cavity of the magazine of the present disclosure may have a length of 101.70 mm+/−1.0 mm. In a further aspect, the magazine of the present disclosure may be comprised of aluminum, stamped steel, titanium, plastic, or a combination thereof.

The features, functions, and advantages that have been discussed can be achieved independently in various examples or may be combined in yet other examples further details of which can be seen with reference to the following description and drawings.

Figure 1A:
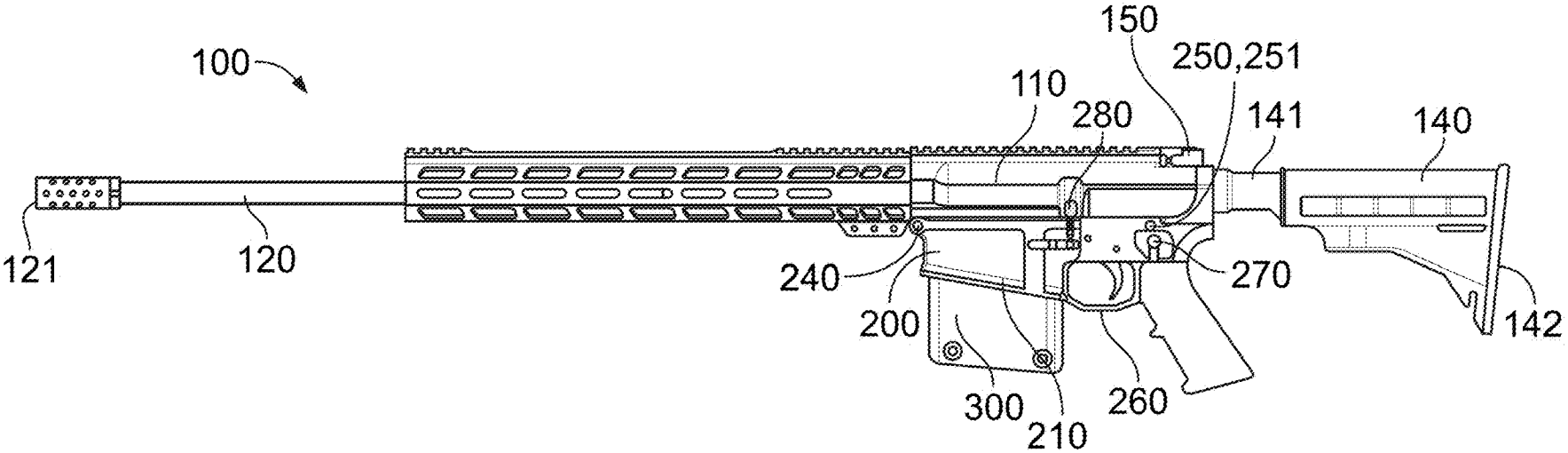
FIGS. 1A-B illustrate perspective views of a firearm, in accordance with various embodiments.

The drawings are for the purpose of illustrating examples, but it is understood that the disclosure is not limited to the arrangements and instrumentalities shown in the drawings.

DETAILED DESCRIPTION

The detailed description of exemplary embodiments provided herein makes reference to the accompanying drawings, which show exemplary embodiments by way of illustration. These exemplary embodiments are described in sufficient detail to enable one of skill in the art to practice the disclosure, and it should be understood that additional embodiments may be applicable without departing from the scope of the disclosure. Accordingly, the detailed description herein is presented for purposes of illustration only and not of limitation. For example, any reference to a singular component or step may include plural embodiments or steps and any reference to more than one component or step may include a singular embodiment or step. Further, any reference to attached, fixed, connected components or the like may include permanent, removable, temporary, partial, full and/or any other possible attachment option, and any reference to such phrases as without contact may also include reduced contact or minimal contact.

In the context of the present disclosure, devices, systems and methods may find particular use in connection with rotating bolt firearms. However, various aspects of the disclosed embodiments may apply equally to applications associated with all types of firearms, including, without limitation, automatic firearms, semi-automatic firearms, bolt action firearms, and the like. In addition, the present disclosure may be equally applicable to firearms using any suitable action including, for example, rotating bolt firearms, and to any suitable actuation system including, for example, gas piston systems, gas impingement systems, and manual actuation systems.

In various exemplary embodiments, and with reference to FIG. 1 through FIG. 7, an AR-10 style rifle 100 is provided. In some embodiments, the firearm 100 may comprise an upper receiver 110 and a lower receiver 200. In some embodiments, the upper receiver 110 may be operatively coupled to the lower receiver 200. In some embodiments, the lower receiver 200 may comprise a magazine well 210. In some embodiments, a barrel 120 may be coupled to the upper receiver 110. In some embodiments, the barrel 120 may be configured to fire a cartridge that is between 73.66 mm and 91.44 mm in length. In some embodiments, a magazine 300 may be configured to be received in the magazine well 210. In some embodiments, the magazine 300 may comprise a cavity 310 configured to receive a cartridge that is between 73.66 mm and 91.44 mm in length.

In some exemplary embodiments, the cavity 310 of the magazine 300 comprises a length of 101.70 mm+/−1.0 mm.

In some exemplary embodiments, the magazine well 210 of the lower receiver 200 comprises a length of 101.70 mm+/−1.0 mm.

In some exemplary embodiments, the magazine well 210 comprises two opposing sidewalls 220, a first end having a first width 221, and a second end having a second width 222 that is larger than the first width.

In some exemplary embodiments, the opposing sidewalls 220 of the magazine well 210 may comprise a first width 221 that ranges from 27.5 mm to 28.5 mm and a second width 222 that ranges from 23.0 mm to 24.0 mm.

In some exemplary embodiments, the magazine well 210 may comprise two opposing sidewalls 220 that are coupled to the first end 230 via rounded corners. In further exemplary embodiments, the two opposing sidewalls 220 of the magazine well 210 may be coupled to the second end 231 via rounded chamfers thereby creating a narrower slot to receive a spine 320 of the magazine 300. Such embodiments have the benefit of advantageously reducing interference when loading the magazine 300 into the magazine well 210. Another advantage of such embodiments includes reducing manufacturing costs by avoiding additional or specialized milling activity of components including, but not limited to, the magazine 300 and/or the magazine well 210.

In some exemplary embodiments, the firearm 100 may comprise a buttstock 140 which may include a first end 141 and a second end 142. In some exemplary embodiments, the first end 141 of the buttstock 140 may be coupled to a second end 122 of the barrel 120. In further exemplary embodiments, the firearm 100 is a rotating bolt firearm that may have a length of a standard AR-10 of 958.85 mm (37.75 inches) with a 508 mm (20 inch) barrel, that extends from a first end of the barrel 121 to the second (posterior) end of the buttstock 142.

In some exemplary embodiments, the lower receiver 200 may include (a) a pivot pin 240 that may be arranged at a first end 205 of the lower receiver 200; (b) a takedown pin 250 that may be arranged at a second end 206 of the lower receiver 200; and/or (c) a trigger guard 260 that may be coupled to the second end 231 of the magazine well 210. In further exemplary embodiments, the trigger guard 260 may be arranged between the pivot pin 240 and the takedown pin 250. In further exemplary embodiments, a safety pin/selector 270 may be positioned in a stacked arrangement with the takedown pin 250.

In some exemplary embodiments, the pivot pin 240 and the takedown pin 250 may be linearly arranged with each other in the lower receiver 200. In some exemplary embodiments, the pivot pin 240 and the takedown pin 250 may be spaced apart by 174.752 mm, as measured from the center of the pivot pin 240 to the center of the takedown pin 250.

In some exemplary embodiments, a stacked arrangement between the safety pin/selector 270 and the takedown pin 250 may further comprise a first portion of the safety pin/selector 271 that is arranged below the takedown pin 250 and a second portion of the safety pin/selector 272 that is arranged distal to the takedown pin 250 relative to the first end of the barrel 121.

Figure 1B:
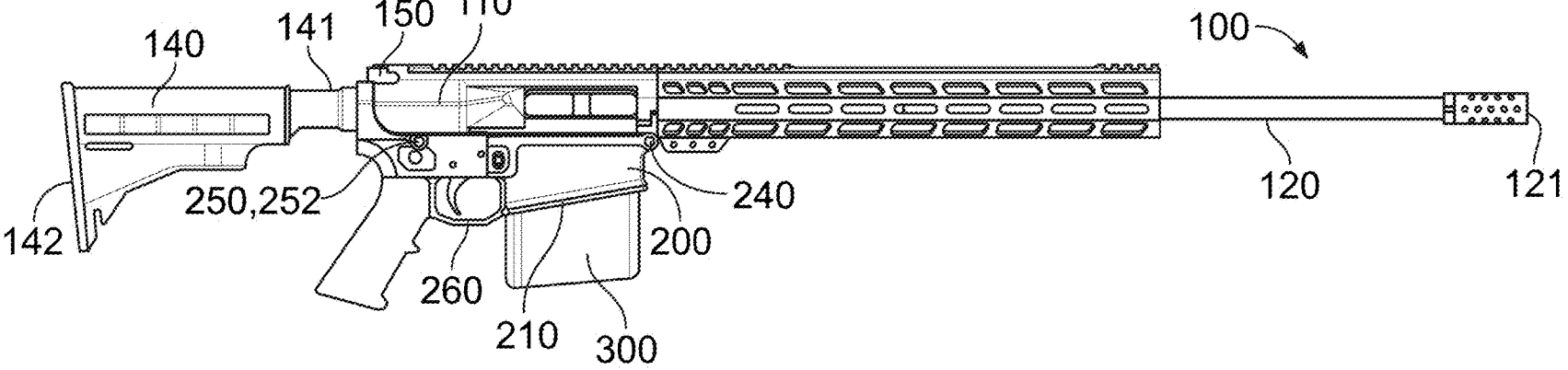
Figure 2A:
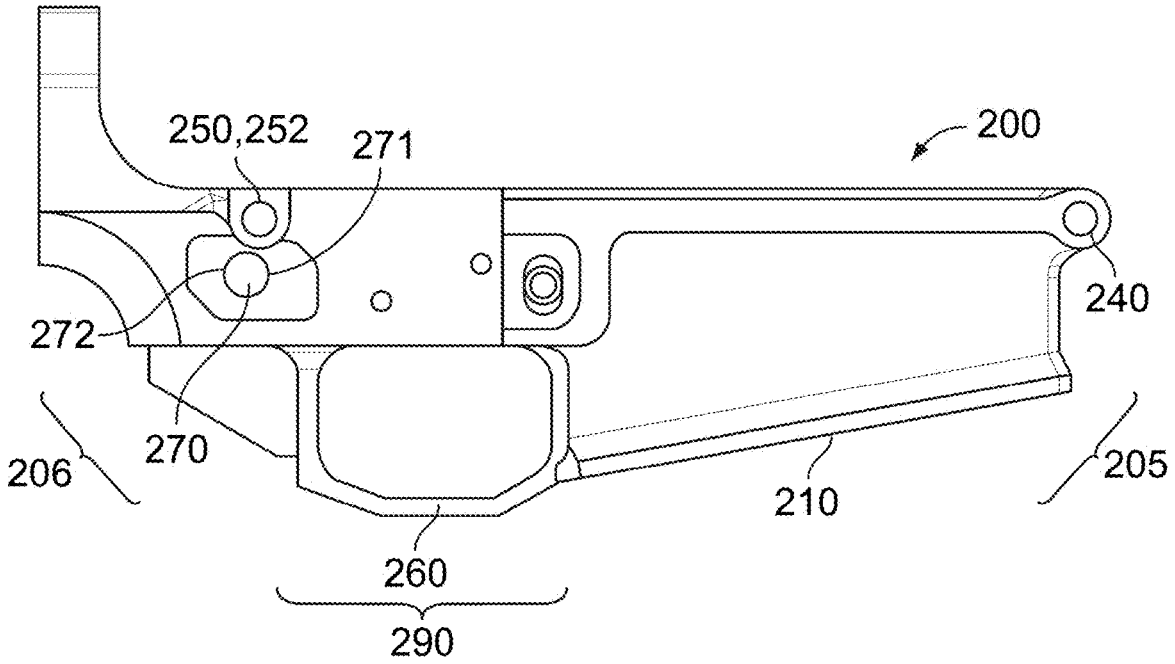
FIGS. 2A-C illustrate perspective views of a lower receiver of a firearm from the sides (FIGS. 2A-B) and the top (FIG. 2C), in accordance with various embodiments.
Figure 2B:
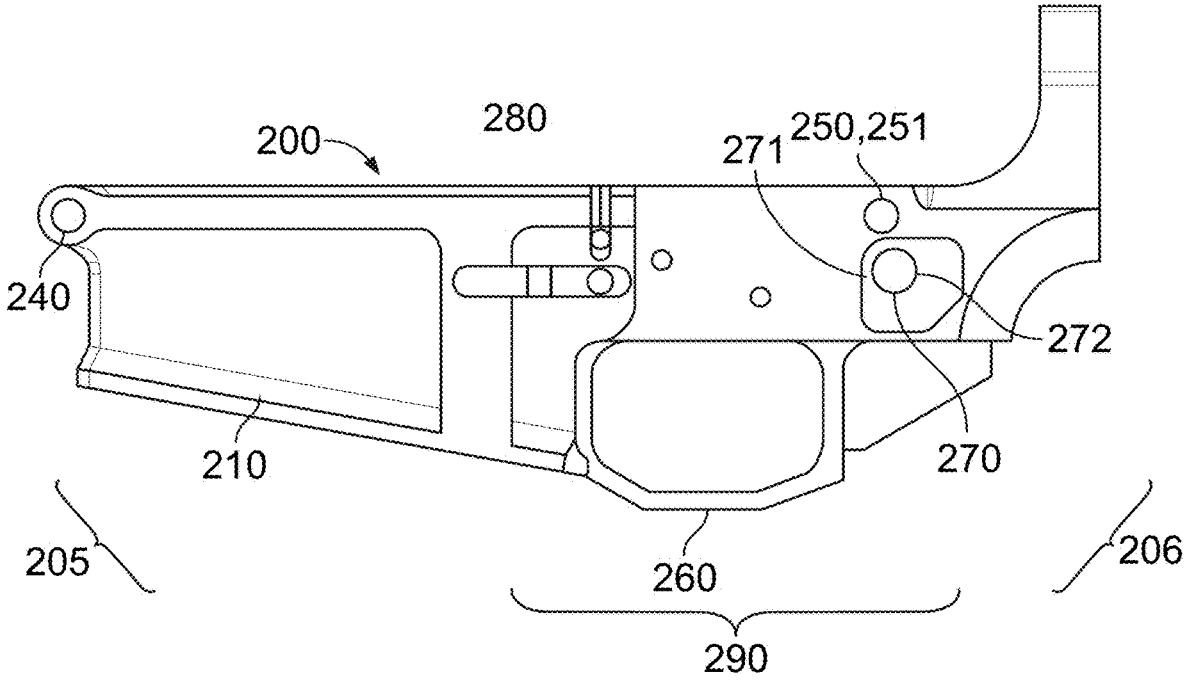
Figure 2C:
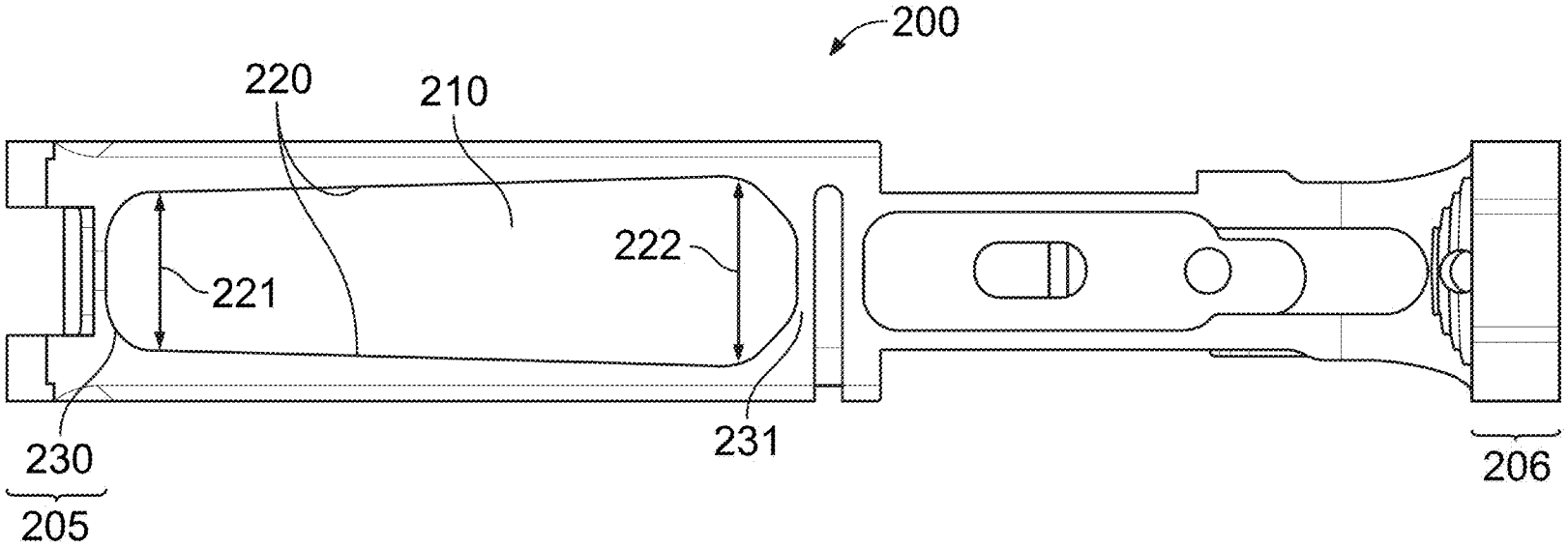
Figure 3A:
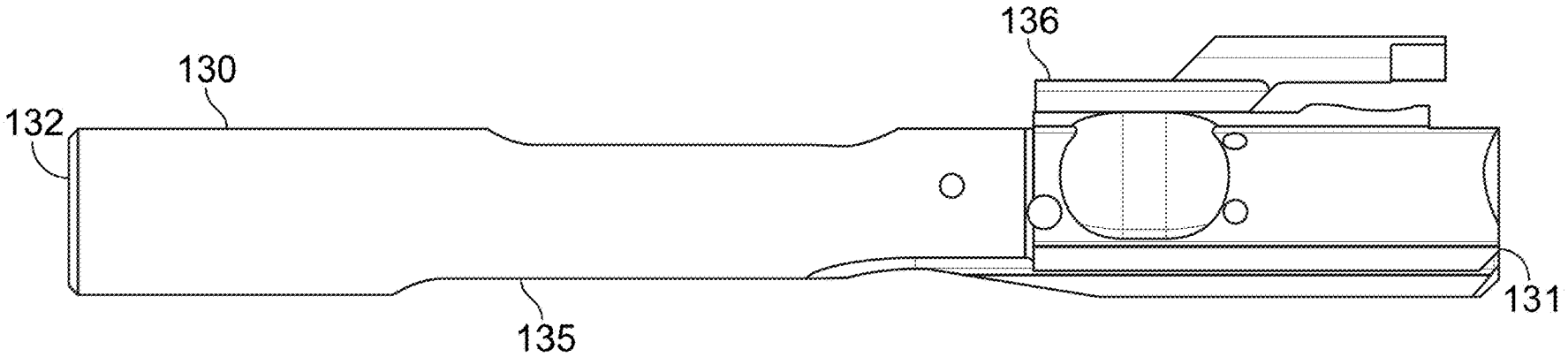
FIGS. 3A-D illustrate perspective views of a bolt carrier from the sides (FIG. 3A-B), the top (FIG. 3C) and the bottom (FIG. 3D), in accordance with various embodiments.
Figure 3B:
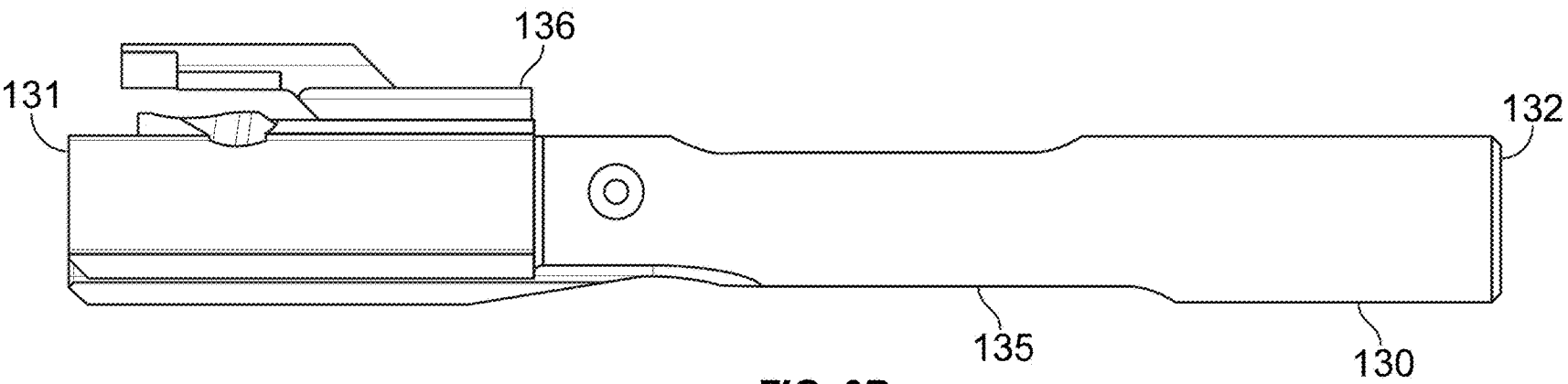
Figure 3C:
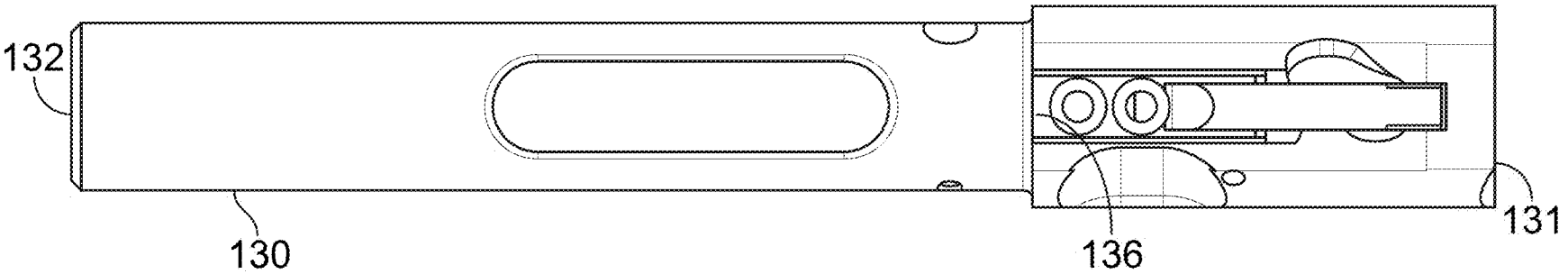
Figure 3D:
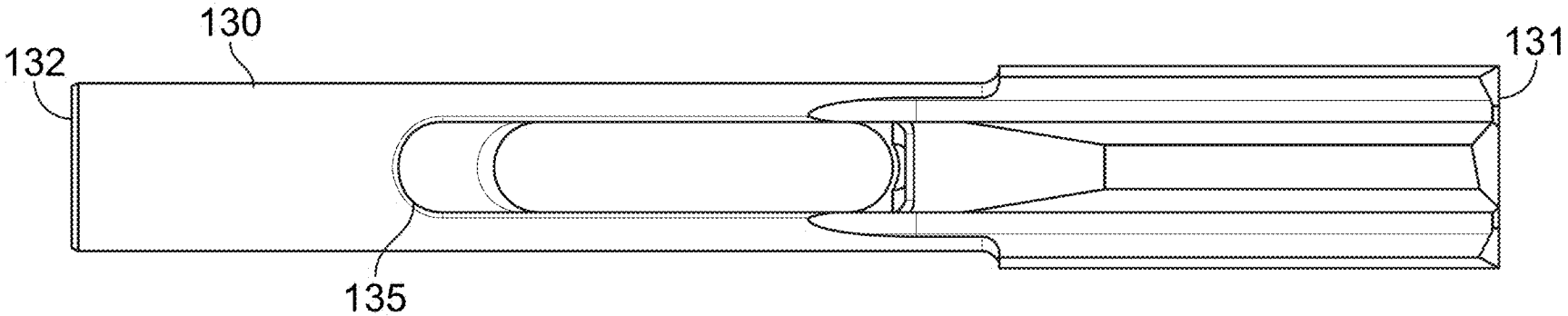
Figure 4A:
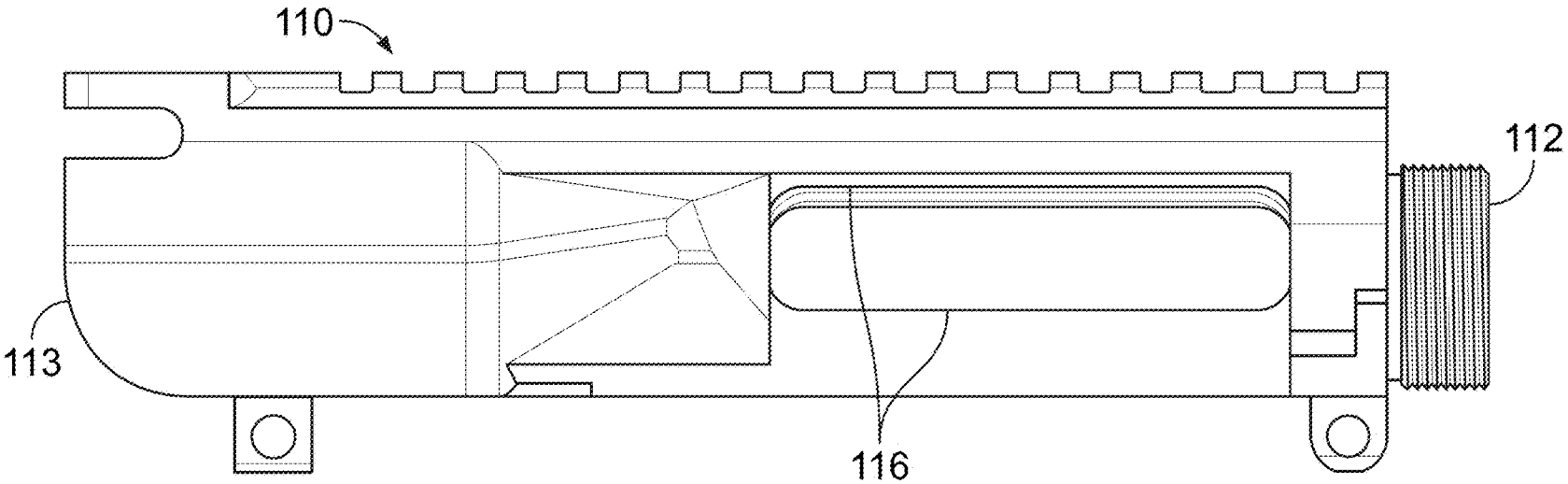
FIGS. 4A-D illustrate a perspective view of an upper receiver of a firearm from the sides (FIGS. 4A-B) the top (FIG. 4C) and the bottom (FIG. 4D), in accordance with various embodiments.
Figure 4B:
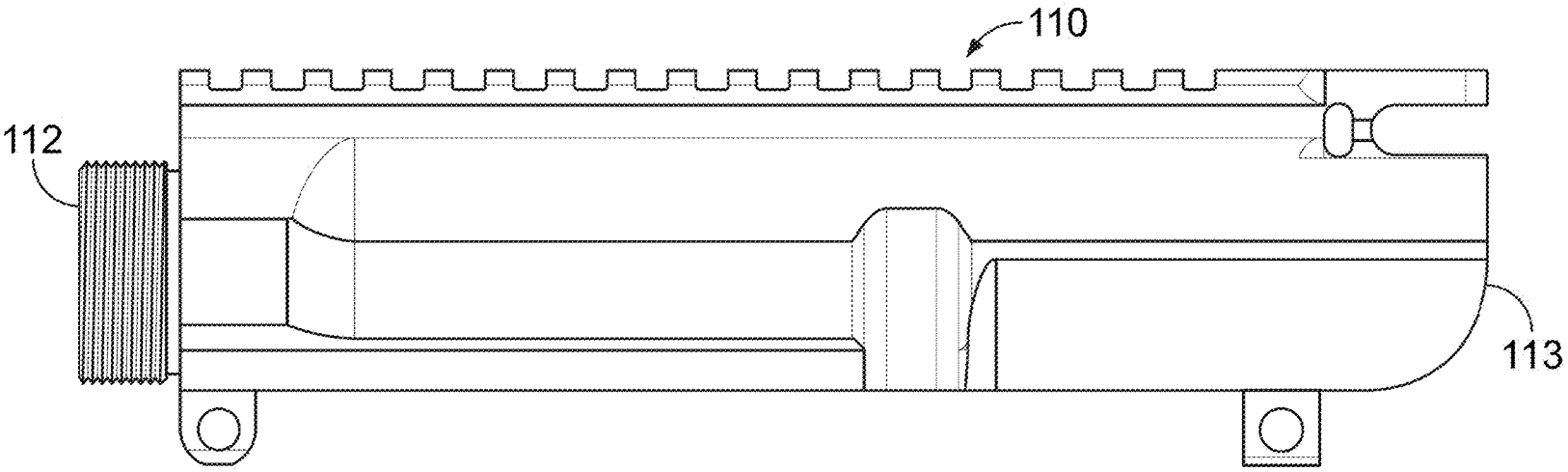
Figure 4C:
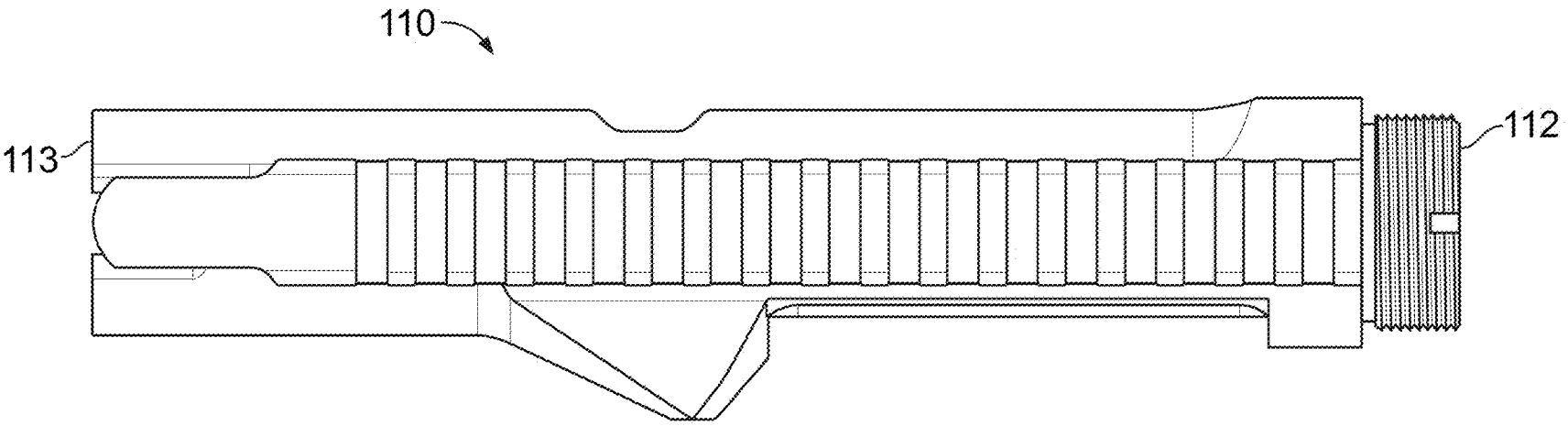
Figure 4D:
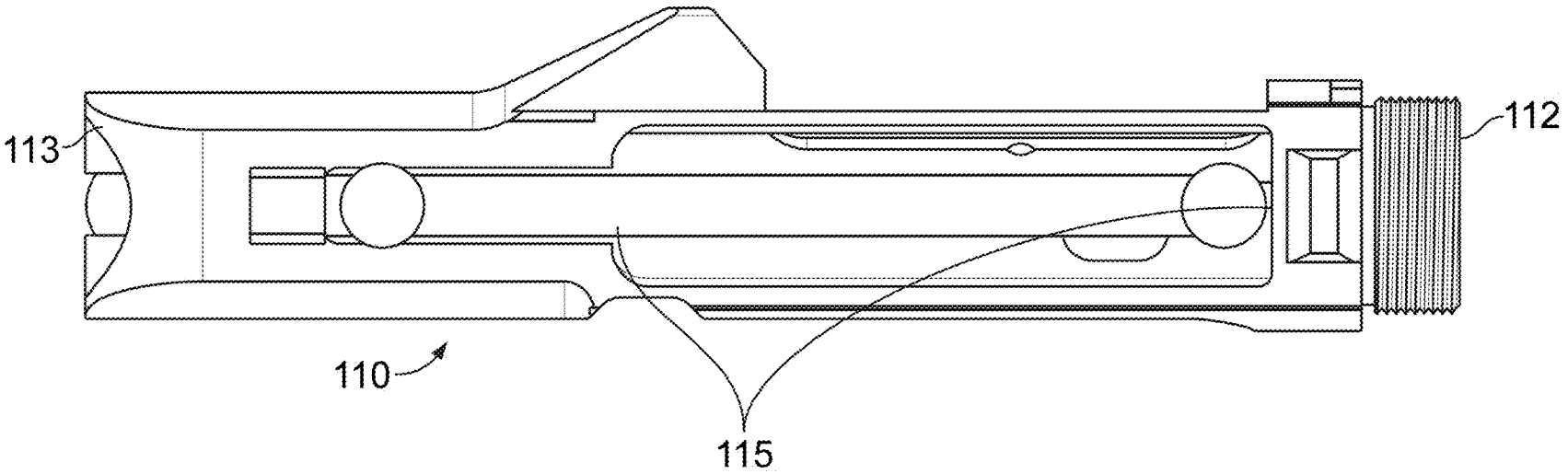
Figure 5A:
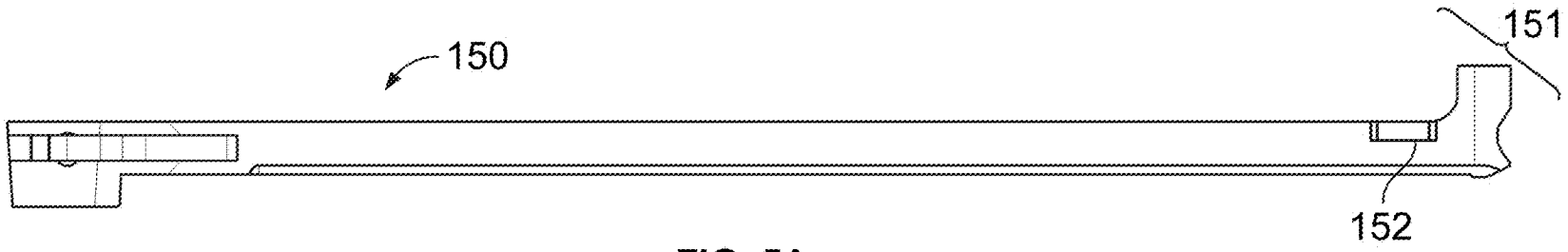
FIGS. 5A-B illustrate perspective views of a charging handle from the side (FIG. 5A) and the top (FIG. 5B), in accordance with various embodiments.
Figure 5B:
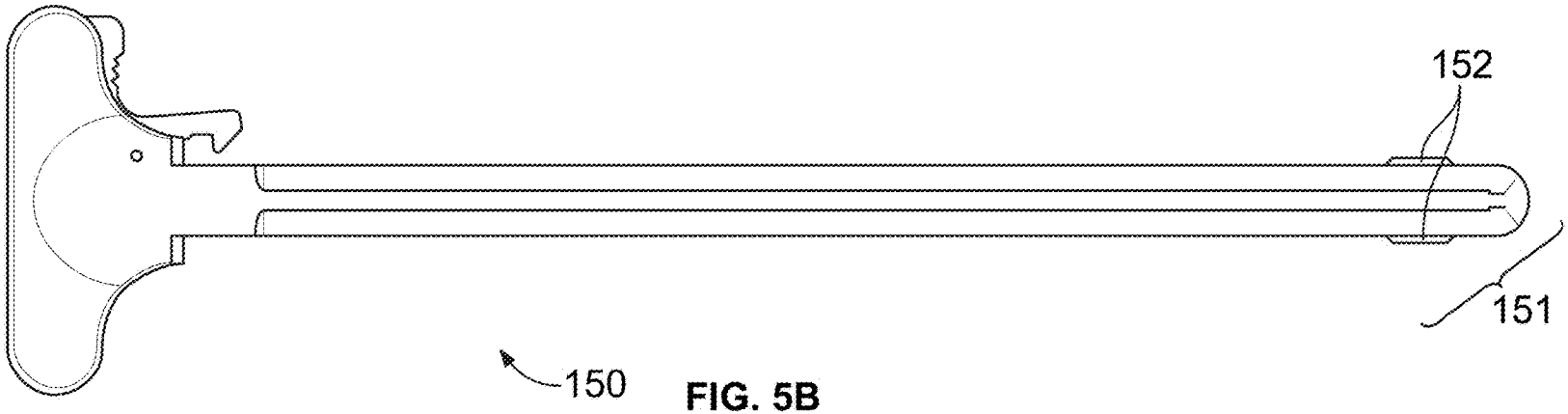
Figure 6:
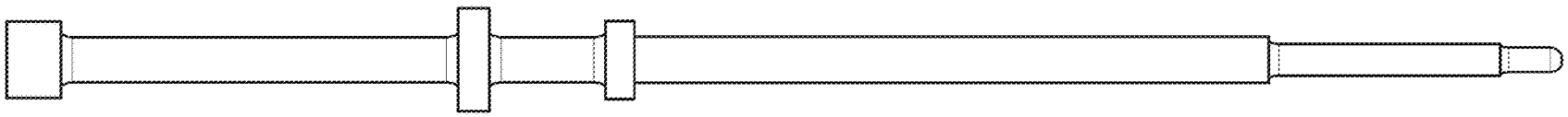
FIG. 6 illustrates a side perspective view of the firing pin, in accordance with various embodiments.
Figure 7A:
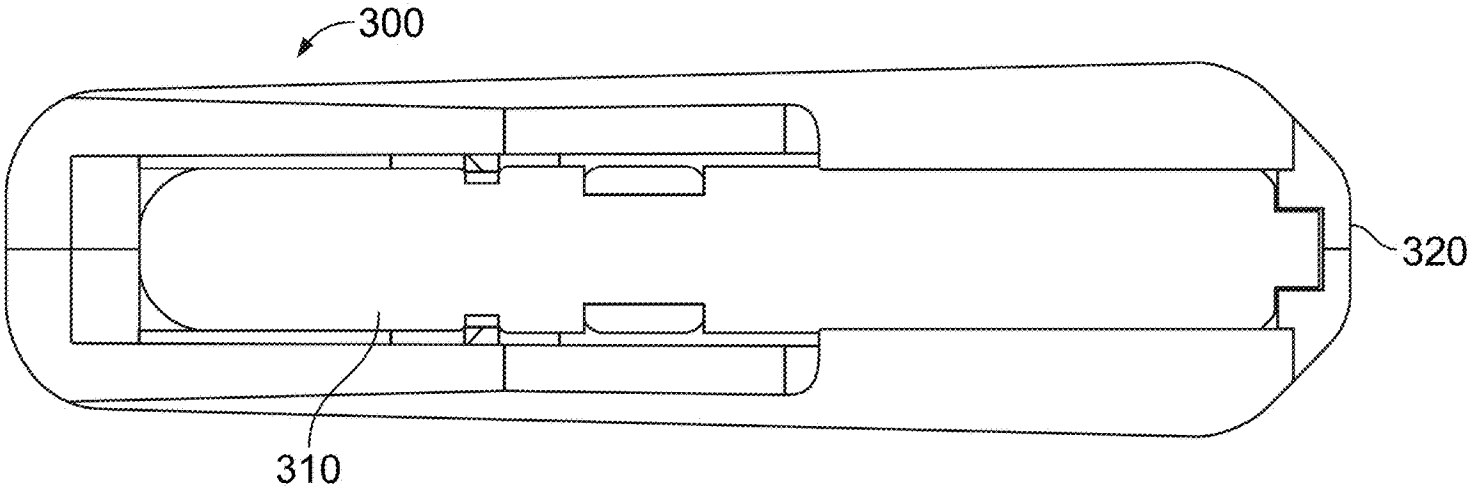
FIGS. 7A-B illustrate perspective views of a magazine from the top (FIG. 7A) and the bottom (FIG. 7B), in accordance with various embodiments.
Figure 7B:
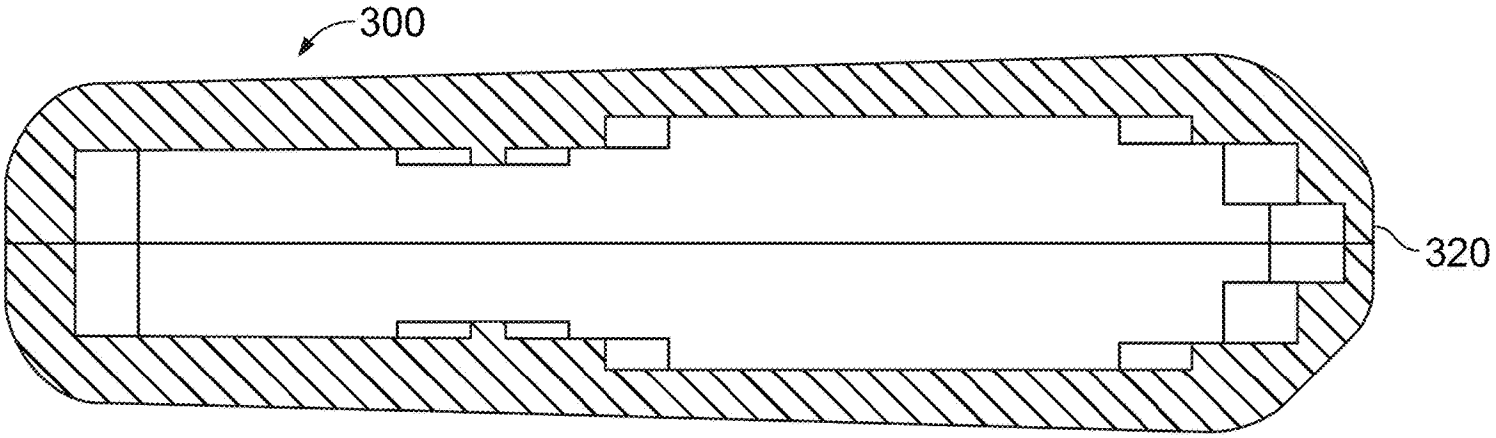
Figure 8A:
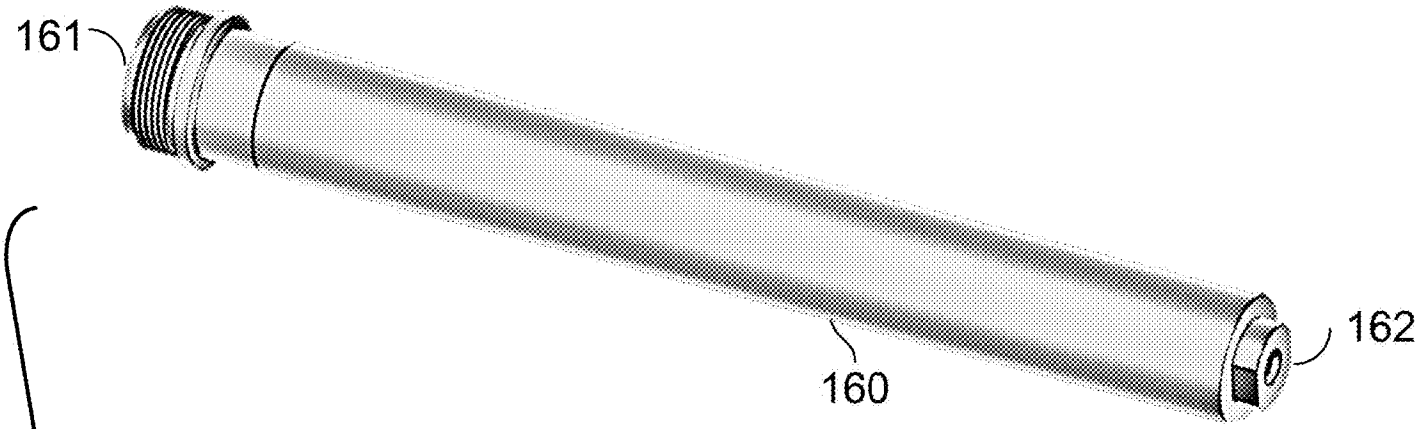
FIGS. 8A-B illustrate perspective views of a buffer assembly comprising a buffer tube (FIG. 8A) and a buffer weight (FIG. 8B), in accordance with various embodiments.
Figure 8B:
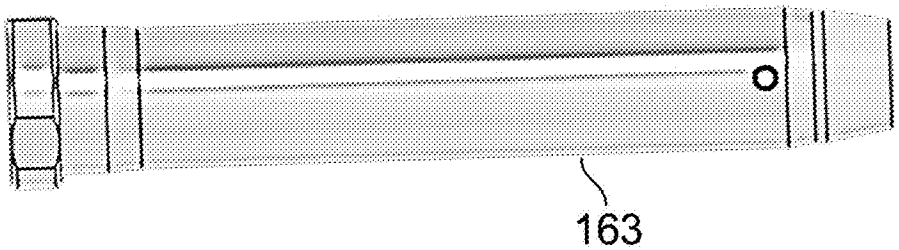

In some exemplary embodiments, the takedown pin 250 is arranged within the lower receiver 200 in such a manner that a first side of the takedown pin 251 is flush with the exterior of the lower receiver 200 on the same side of the firearm 100 as a safety pin/selector 270 is located (as shown in FIG. 1A), and a second side of the takedown pin 252 protrudes from the exterior of the lower receiver 200 on the opposing second side of the firearm 100, as shown in FIG. 1B.

In some exemplary embodiments, the lower receiver 200 may also comprise a bolt catch 280, wherein the position of the bolt catch 280 is shifted to a position behind the elongated magazine well 210 towards the second (posterior) end of the lower receiver 206. Such embodiments have the benefit of advantageously allowing for an elongated magazine well 210 that may be configured to receive a magazine 300 that may receive a cartridge that is between 73.66 mm and 91.44 mm in length.

In some further exemplary embodiments, the upper receiver 110 may also include a slot 115 located on the underside of the upper receiver, wherein the length of the slot 115 is 111.25 mm. In contrast, the length of the slot on the underside of the upper receiver in a standard AR-10 is 89.66 mm. The increased length of the slot 115 on the underside of the upper receiver is necessary to enable use of the larger ammunition in accordance with exemplary embodiments of the present disclosure. In further embodiments, an ejection port 116 located on the right side of the upper receiver may be wider than an ejection port on a standard AR-10. In some instances, the ejection port 116 is 18.24 mm wide, whereas the slot on a standard AR-10 is 14.22 mm wide. The increased width of the ejection port 116 provides a benefit of advantageously allowing for ejection of the larger ammunition or ammunition casing, in accordance with exemplary embodiments of the present disclosure.

In some exemplary embodiments, a charging handle 150 may be coupled to the upper receiver 110, wherein the charging handle 150 has opposing sides that each have tangs 152 that may be arranged 10 mm from a first end of the charging handle 151. Such embodiments provide the benefit of advantageously allowing the charging handle 151 to travel back farther towards a second (posterior) end of the upper receiver 113, thereby accommodating an elongated or larger magazine 300 that may receive a cartridge that is between 73.66 mm and 91.44 mm in length. In contrast, the distance of the tangs from the first end of the charging handle in a standard AR-10 is 25.3 mm, which is not capable of receiving an elongated or larger magazine for larger caliber ammunition as provided in the present disclosure.

In some exemplary embodiments, the firearm 100 may include a bolt carrier 130 coupled to the upper receiver 110 wherein the bolt carrier 130 may comprise a gas key 136, wherein the diameter of the bolt carrier from a first end of the bolt carrier 161 to the gas key 136 may comprise 23.62 mm, with the length from the first end of the bolt carrier 161 to the gas key 136 comprising 135.2 mm. In comparison, a standard AR-10 has a diameter of 23.62 mm for a length of 116.7 mm. The increased length of the smaller diameter provided in the present disclosure provides the benefit of reducing the weight of certain embodiments of the present disclosure. In some further embodiments, the bolt carrier 130 comprises a slot 135 on the underside of the bolt carrier, wherein the length of the slot 135 on an underside of the bolt carrier is 71 mm. In comparison, the length of the slot of the bolt carrier in a standard AR-10 is 55.9 mm. The increased length of the slot 135 according to exemplary embodiments of the present disclosure is necessary to enable use of larger ammunition, and the increased length of the slot also includes advantages of providing clearance for a relocated fire control group 290 and reducing the weight of certain embodiments of the present disclosure.

In additional exemplary embodiments, the bolt carrier 130 also includes a firing pin 137 arranged at a second end of the bolt carrier 132, wherein the firing pin 137 has a length of 121.6 mm. In contrast, the firing pin of a standard AR-10 has a length of 100 mm. The increased length of the firing pin according to exemplary embodiments of the present disclosure also provides advantages of enabling use of ammunition with a cartridge having a length between 73.66 mm and 91.44 mm.

In some exemplary embodiments, the magazine 300 is configured to hold 5 to 30 rounds of cartridges with a length of between 73.66 mm and 91.44 mm. In some embodiments, the magazine 300 is configured to hold 5 rounds of cartridges with a length of between 73.66 mm and 91.44 mm. Some exemplary ammunition types may include: .300 Winchester Magnum, .300 Precision Rifle Cartridge ("PRC"), 6.5 PRC, .30-06 ammunition, .270 Winchester, 7 mm Magnum, and 7 mm PRC. Other ammunition with a cartridge length between 73.66 mm (2.9 inches) and 91.44 mm (3.6 inches) would be readily known by one of ordinary skill in the art.

In some exemplary embodiments, the barrel 120 may be configured to fire a .300 Winchester Magnum cartridge. In other exemplary embodiments, the barrel 120 may be configured to fire a .300 PRC cartridge. In other exemplary embodiments, the barrel 120 may be configured to fire a 6.5 PRC cartridge. In other exemplary embodiments, the barrel 120 may be configured to fire a .30-06 cartridge. In other exemplary embodiments, the barrel 120 may be configured to fire a .270 Winchester cartridge. In other exemplary embodiments, the barrel 120 may be configured to fire a 7 mm Magnum cartridge. In still other exemplary embodiments, the barrel 120 may be configured to fire a 7 mm PRC cartridge. The barrel 120 may also be configured to fire any ammunition with a cartridge length between 73.66 mm and 91.44 mm, as would be readily known by one of ordinary skill in the art.

In some exemplary embodiments, the firearm 100 further comprises a buffer assembly 159 comprising a buffer tube 160 having a first end 161 and a second end 162, wherein the second end of the bolt carrier 132 is received in the first end of the buffer tube 161, a buffer spring (not pictured) and a buffer weight 163, wherein the buffer weight has a length of 117 mm+/−3 mm and a weight of 8 oz+/−3 oz.

In some exemplary embodiments, the magazine 300 may be comprised of aluminum, stamped steel, titanium, or plastic.

In some exemplary embodiments, the firearm 100 in an unloaded condition comprises a total weight that is no more than the total weight of a standard AR-10 in an unloaded condition. In some exemplary embodiments, the total length of the firearm 100 of the present disclosure is no longer than the length of a standard AR-10 with the same respective barrel length. In some exemplary embodiments, the firearm 100 in an unloaded condition comprises a total weight that is less than other semi-automatic firearms configured to fire ammunition with a cartridge length between 73.66 mm and 91.44 mm, including but not limited to an AR-10 firearm configured to fire ammunition with a cartridge length between 73.66 mm and 91.44 mm.

Alternative implementations are included within the scope of the examples of the present disclosure in which functions may be executed out of order from that shown or discussed, including substantially concurrent or in reverse order, depending on the functionality involved, as would be understood by those reasonably skilled in the art.

The invention claimed is:

1. A firearm comprising:

an upper receiver;

a lower receiver coupled to the upper receiver, wherein the lower receiver comprises a magazine well, wherein the magazine well has a length of 101.7 mm+/−1.0 mm;

a pivot pin arranged at a first end of the lower receiver;

a takedown pin arranged at a second end of the lower receiver;

a trigger guard coupled to a second end of the magazine well, wherein the trigger guard is arranged between the pivot pin and the takedown pin;

a safety pin; and a bolt catch, wherein the position of the bolt catch is shifted to a position posterior to the magazine well;

a barrel coupled to the upper receiver, wherein the barrel is configured to fire a cartridge having a length between 73.66 mm and 91.44 mm;

a buttstock having a first end and a second end, wherein the first end of the buttstock is coupled to a second end of the barrel, and wherein the firearm is a rotating bolt firearm; and a magazine configured to be received in the magazine well, the magazine having a cavity configured to receive a cartridge having a length between 73.66 mm and 91.44 mm, and wherein the firearm has a length of a standard AR-10 of 958.85 mm (37.75 inches) with a 508 mm (20 inch) barrel, that extends from a first end of the barrel to the second end of the buttstock.

2. The firearm according to claim 1, wherein the cavity of the magazine has a length of 101.7 mm+/−1.0 mm.

3. The firearm according to claim 1, wherein the magazine well has two opposing sidewalls, a first end having a first width, and a second end having a second width that is larger than the first width.

4. The firearm according to claim 3, wherein the first width ranges from 27.5 mm to 28.5 mm and the second width ranges from 23 mm to 24 mm.

5. The firearm according to claim 3, wherein the two opposing sides are coupled to the first end via rounded corners and wherein the two opposing sides are coupled to the second end via rounded chamfers thereby creating a narrower slot to receive a spine of the magazine.

6. The firearm according to claim 1, wherein the safety pin has a stacked arrangement with the takedown pin.

7. The firearm according to claim 1, wherein the pivot pin and the takedown pin are linearly arranged with each other in the lower receiver and are spaced apart by 174.752 mm measured from center to center.

8. The firearm according to claim 6, wherein the stacked arrangement between the safety pin and the takedown pin further comprises a first portion of the safety pin arranged below the takedown pin and second portion of the safety pin arranged distal to the takedown pin relative to the first end of the barrel.

9. The firearm according to claim 6, wherein the takedown pin is arranged within the lower receiver such that a first side of the takedown pin is flush with an exterior of the lower receiver on a first side where a safety switch is located, and wherein the takedown pin protrudes from the exterior of the lower receiver on an opposing second side.

10. The firearm according to claim 1, wherein the upper receiver further comprises:

a slot located on a underside of the upper receiver, wherein the length of the slot is 111.25 mm, and an ejection port located on a right side of the upper receiver, wherein the ejection port is 18.24 mm wide.

11. The firearm according to claim 1, further comprising a charging handle coupled to the upper receiver, wherein the charging handle has opposing sides that each have a tang arranged 10 mm from a first end of the charging handle.

12. The firearm according to claim 1, further comprising:

a bolt carrier coupled to the upper receiver, wherein the bolt carrier comprises a gas key, wherein the diameter of the bolt carrier from a first end of the bolt carrier to the gas key comprises 23.62 mm, and wherein the length from the first end of the bolt carrier to the gas key comprises 135.2 mm, and a slot located on an underside of the bolt carrier, and wherein the length of the slot on the underside of the bolt carrier is 71 mm; and, a firing pin arranged at a second end of the bolt carrier, wherein the firing pin has a length of 121.6 mm.

13. The firearm according to claim 1, wherein the magazine is configured to hold 5 to 30 rounds of cartridges having a length between 73.66 mm and 91.44 mm.

14. The firearm according to claim 13, wherein the magazine is configured to hold 5 rounds of cartridges having a length between 73.66 mm and 91.44 mm.

15. The firearm according to claim 1, further comprising:

a buffer assembly having a buffer tube with a first end and a second end, wherein a second end of the bolt carrier is received in the first end of the buffer tube, and a buffer weight, wherein the buffer weight has a length of 117 mm+/−3 mm and a weight of 8 oz+/−3 oz.

16. The firearm according to claim 1, wherein the magazine may be made of a material selected from a group consisting of aluminum, stamped steel, titanium, or plastic.

17. The firearm according to claim 1, wherein a total weight of the firearm in an unloaded condition is no more than a total weight of a standard AR-10 in the unloaded condition.

18. The firearm according to claim 1, wherein the firearm is configured to receive a cartridge that is one or more of: .300 Winchester Magnum, .300 Precision Rifle Cartridge ("PRC"), 6.5 PRC, .30-06 ammunition, .270 Winchester, 7 mm Magnum, and 7 mm PRC.

* * * * *